US007599510B2

(12) United States Patent
Ueda et al.

(10) Patent No.: US 7,599,510 B2
(45) Date of Patent: Oct. 6, 2009

(54) MULTIFUNCTIONAL ACTUATOR AND MOBILE TERMINAL

(75) Inventors: Minoru Ueda, Tokyo (JP); Shoichi Kaneda, Tokyo (JP); Etsuo Ohno, Kuroishi (JP)

(73) Assignee: Namiki Seimitsu Houseki Kabushiki Kaisha (JP)

( * ) Notice: Subject to any disclaimer, the term of this patent is extended or adjusted under 35 U.S.C. 154(b) by 266 days.

(21) Appl. No.: 10/546,189

(22) PCT Filed: Feb. 25, 2004

(86) PCT No.: PCT/JP2004/002195

§ 371 (c)(1),
(2), (4) Date: Oct. 12, 2006

(87) PCT Pub. No.: WO2004/077879

PCT Pub. Date: Sep. 10, 2004

(65) Prior Publication Data

US 2007/0060207 A1 Mar. 15, 2007

(30) Foreign Application Priority Data

Feb. 27, 2003 (JP) ..... 2003-051050

(51) Int. Cl.
*H04R 1/00* (2006.01)

(52) U.S. Cl. ..... 381/396; 381/334; 381/336; 335/222

(58) Field of Classification Search ..... 381/344, 381/396, 417, 412, 334, 336; 340/388.5, 340/388.6; 335/222
See application file for complete search history.

(56) References Cited

U.S. PATENT DOCUMENTS

| | | | | |
|---|---|---|---|---|
| 5,953,436 | A * | 9/1999 | Zimmermann | 381/396 |
| 6,211,775 | B1 * | 4/2001 | Lee et al. | 340/407.1 |
| 6,570,993 | B1 * | 5/2003 | Fukuyama | 381/396 |
| 6,678,387 | B2 * | 1/2004 | Kemmerer | 381/397 |
| 6,850,138 | B1 * | 2/2005 | Sakai | 335/222 |
| 7,181,040 | B2 * | 2/2007 | Ohta | 381/398 |
| 2001/0030474 | A1 | 10/2001 | Sakai et al. | |
| 2003/0081807 | A1 * | 5/2003 | Furuya | 381/396 |

FOREIGN PATENT DOCUMENTS

| | | |
|---|---|---|
| JP | 10-187160 | 7/1998 |
| JP | 2000-325881 | 11/2000 |

(Continued)

*Primary Examiner*—Curtis Kuntz
*Assistant Examiner*—Ryan C Robinson
(74) *Attorney, Agent, or Firm*—Studebaker & Brackett PC; Donald R. Studebaker

(57) ABSTRACT

The present invention is a multifunctional actuator including a magnetic circuit, a suspension that supports the magnetic circuit, a diaphragm positioned facing the magnetic circuit, and a voice coil that is mounted on the diaphragm and inserted in a circular air gap of the magnetic circuit, comprising a housing to accommodate the magnetic circuit, and a cover to cover an open end of the housing, wherein a sound release gap is formed between an outer periphery of the housing and a side wall of the cover for communication between the inside and outside of said housing. Thereby, it can prevent the infiltration of foreign matter into the housing without attaching a dust mesh or non-woven fabric over the sound release hole.

8 Claims, 7 Drawing Sheets

FOREIGN PATENT DOCUMENTS

| | | |
|---|---|---|
| JP | 2001-102769 | 4/2001 |
| JP | 2001-225010 | 8/2001 |
| JP | 2001293436 | 10/2001 |
| JP | 2001-353471 | 12/2001 |
| JP | 2002219413 | 6/2002 |

* cited by examiner

MULTIFUNCTIONAL ACTUATOR AND MOBILE TERMINAL

TECHNICAL FIELD

The present invention relates to a multifunctional actuator that is mounted in a mobile terminal, such as a mobile phone and a miniature information communication terminal, to inform a user, by means of an audible tone or vibration, of an incoming call, and particularly to the multifunctional actuator that has a sound hole.

BACKGROUND ART

Conventionally, multifunctional vibrating actuators that have sound holes in their covers (see patent document 1: Japanese Patent Application Laid-Open No. 2001-293436 (FIG. 1)) and multifunctional vibrating actuators that have an anti-dust mesh on their protective covers (see patent document 2: Japanese Patent Application Laid-Open No. 2002-219413 (FIG. 1)) are known.

However, there is a problem with the conventional multifunction vibrating actuators (patent document 1) that there are no countermeasures to dust, and so dust and other foreign matter enters the area from which the vibrations are conveyed, through sound release holes in the cover. Further, because one multifunctional vibrating actuator (patent document 2) has the anti-dust mesh attached to the protective cover, no foreign matter enters the area from which the vibrations are conveyed, but there is a problem that material costs and production costs are increased to the extent required to attach the anti-dust mesh. Moreover, when the multifunctional vibrating vibrator is positioned on a base plate or in a case, the sound release holes are provided on the back surface (the cover surface) of the multifunctional vibrating actuator, and so there is a problem that it is necessary to establish a gap between the cover surface of the multifunctional vibrating actuator and the base plate or the case, or to make sound release holes in the base plate or the like.

DISCLOSURE OF THE INVENTION

The present invention has been devised in view of the problems described above, and an object of the present invention is to provide the multifunctional actuator that can prevent the infiltration of foreign matters into the housing without attaching the anti-dust mesh or non-woven fabric to the sound release holes and that can be securely placed on the base plate or the like.

The invention described in claim 1 is a multifunctional actuator including a magnetic circuit, a suspension that supports the magnetic circuit, a diaphragm positioned facing the magnetic circuit, and a voice coil that is mounted on the diaphragm and inserted in a circular air gap of the magnetic circuit, comprising a housing to accommodate the magnetic circuit, and a cover to cover an open end of the housing, wherein a sound release gap is formed between an outer periphery of the housing and a side wall of the cover for communication between the inside and outside of the housing.

This gap is formed so as to communicate between the inside and the outside of the housing, and so functions as a sound release hole. Further, this gap is formed between the outer periphery of the housing and the side wall of the cover and does not directly pierce the outer periphery of the housing, and so foreign matters are kept from infiltrating into the housing.

Moreover, because the sound release gap is established at the side of the multifunctional actuator, the multifunctional actuator can be securely placed on the base plate or the like.

The invention described in claim 2 is the multifunctional actuator as described in claim 1, wherein the sound release gap is formed by a thin part provided at the outer periphery of the housing, a cut-out provided on an open end of the thin part, and the side wall of said cover.

The invention described in claim 3 is the multifunctional actuator as described in claim 1 or 2, wherein there are provided a hole in the side wall of the cover and a projection on the outer periphery of the housing that fits into said hole.

Because the hole in the side wall of the cover and the projection on the outer periphery of the housing fit together, it is possible to fix the cover to the housing without use of an adhesive.

The invention described in claim 4 is a mobile terminal equipped with the multifunctional actuator as described in any one of claims 1 through 3.

BEST MODE FOR CARRYING OUT THE INVENTION

Figure 1:
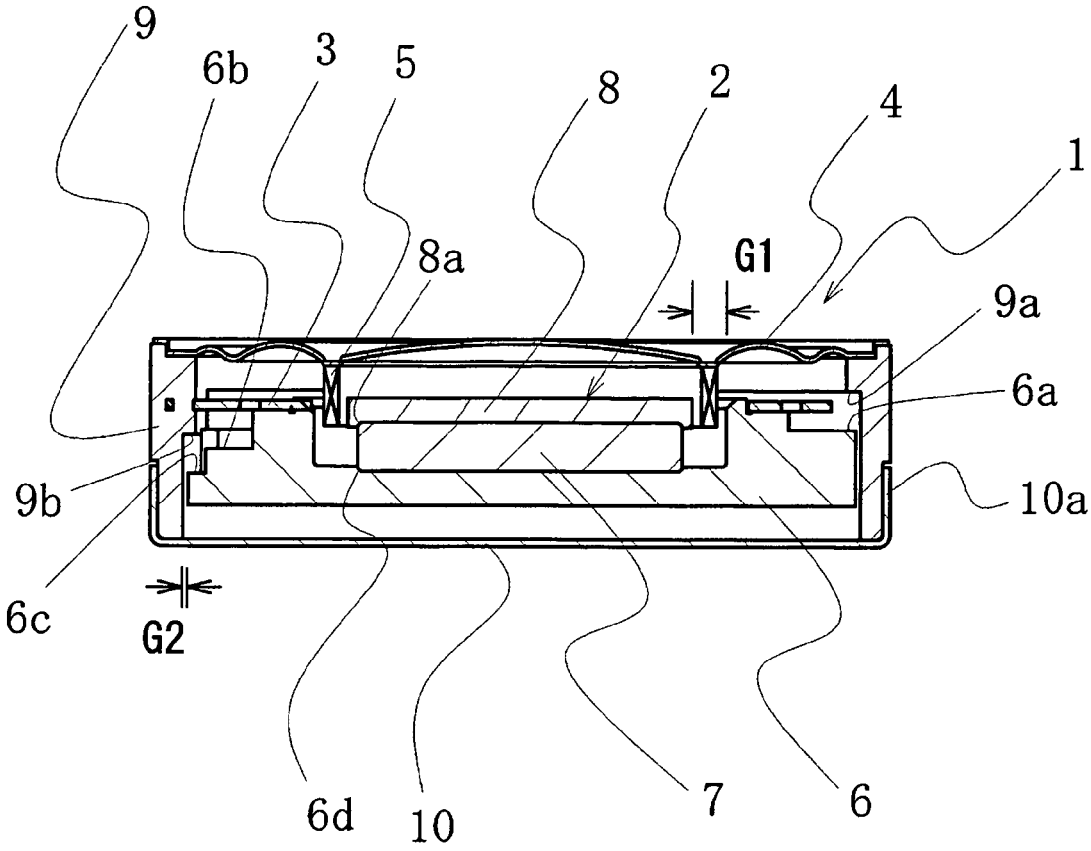
FIG. 1 is a sectional view of a multifunctional actuator of the present embodiment, taken along line A-A (see FIG. 5)

The multifunctional actuator 1 of an embodiment of the present invention includes, as shown in FIG. 1, a magnetic circuit 2, a suspension 3, a diaphragm 4, and a voice coil 5. When a signal in the audible frequency range flows through the voice coil 5, the diaphragm 4 vibrates to produce an audible signal such as a ring tone, a melody, or a voice signal. Further, when a signal in a frequency range such as 120 to 160 Hz flows through the voice coil 5, the multifunctional actuator vibrates its mechanical vibration system, which includes the magnetic circuit 2 and the suspension 3.

Figure 2:
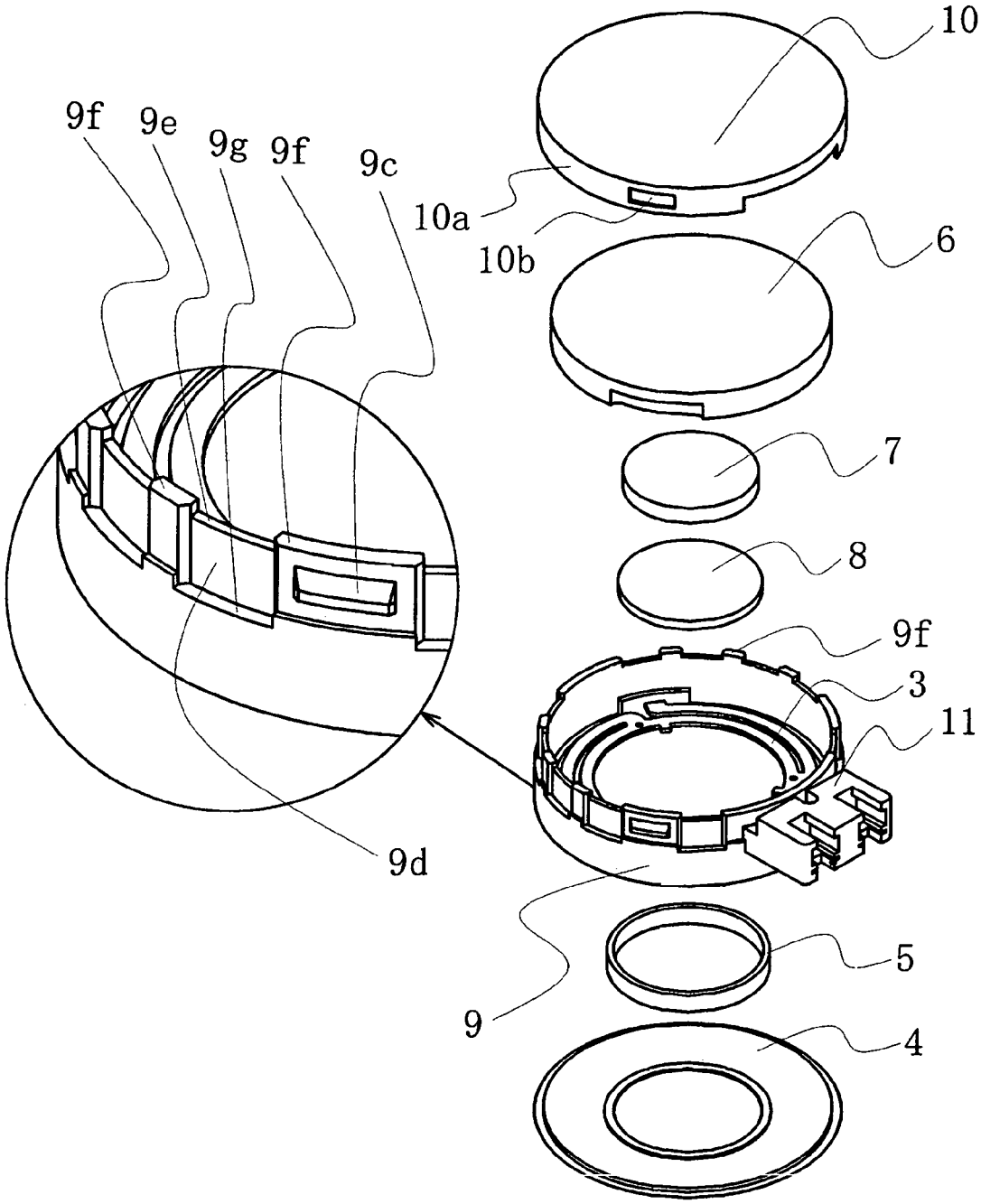
FIG. 2 is an exploded perspective view of the multifunctional actuator of the present embodiment.

The magnetic circuit 2, as shown in FIGS. 1 and 2, comprises a yoke 6 in the shape of a cylinder with a floor, a magnet 7 in the shape of a round plate, and a pole piece 8 in the shape of a round plate, all with the same central axis.

Figure 3:
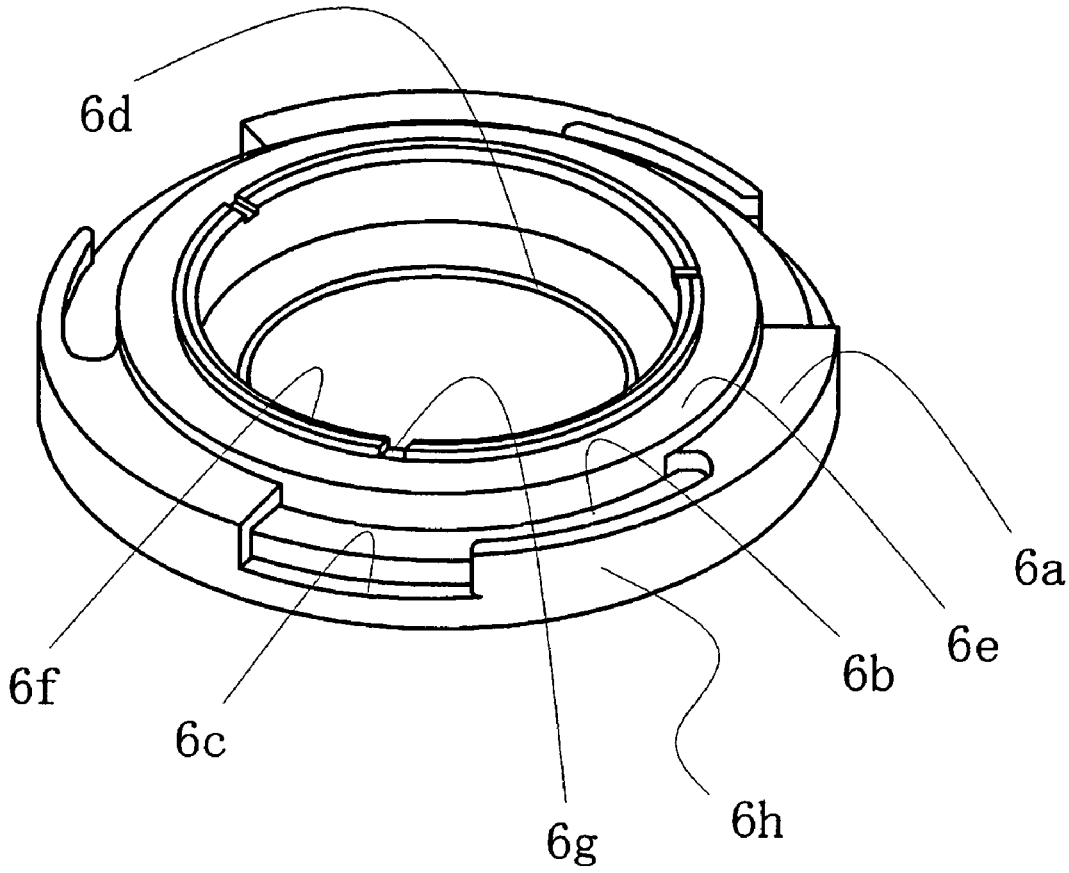
FIG. 3 is an explanatory diagram of a yoke of the multifunctional actuator of the present embodiment.

The yoke 6 is formed in the shape of the cylinder with the floor, as shown in FIG. 3, and is formed with a flange **6*h* so that it is positioned within the inside wall of a housing 9 and separated from it by a small gap. This yoke 6 has step faces 6*a*, suspension recesses 6*b*, molded part recesses 6*c*, and a back facing 6*d*** to set the position of the magnet; it is formed of magnetic material.

The back facing **6*d* that sets the position of the magnet 7 is part of the yoke 6. The diameter of the back facing 6*d* is about the same as the diameter of the magnet 7, so that it can set the position of the magnet 7**.

The step face 6*a* is a step down from an end face 6*e* that fixes the ring of the suspension 3. During vibration of the magnetic circuit 2, this step face 6*a* is in contact with a ring face 9*a* of the housing 9. Further, a ring-shaped stop frame 6*f*, which has an outer diameter that fits with the ring of the suspension 3, rises from the end face 6*e*. The stop frame 6*f* has cut-outs located at 120 degree intervals that match with fittings 3*b* on the suspension 3 and keep the suspension 3 from slipping around in a circle.

The suspension recesses 6*b* are formed as concavities following the circumference of the yoke 6 in positions facing arms 3*d* of the suspension 3 shown in FIG. 3. These suspension recesses 6*b* function as space for the arms 3*d* to flex. Thus, during vibration of the magnetic circuit 2, the yoke 6 does not interfere with the vibration of the magnetic circuit 2 even though the arms 3*d* flex.

The molded part recesses 6*c*, as shown in FIGS. 1 and 3, are located further out on the circumference of the suspension recesses 6*b*; they follow the circumference of the yoke 6 and are formed by cutting away the outer edge of the yoke.

Figure 4:
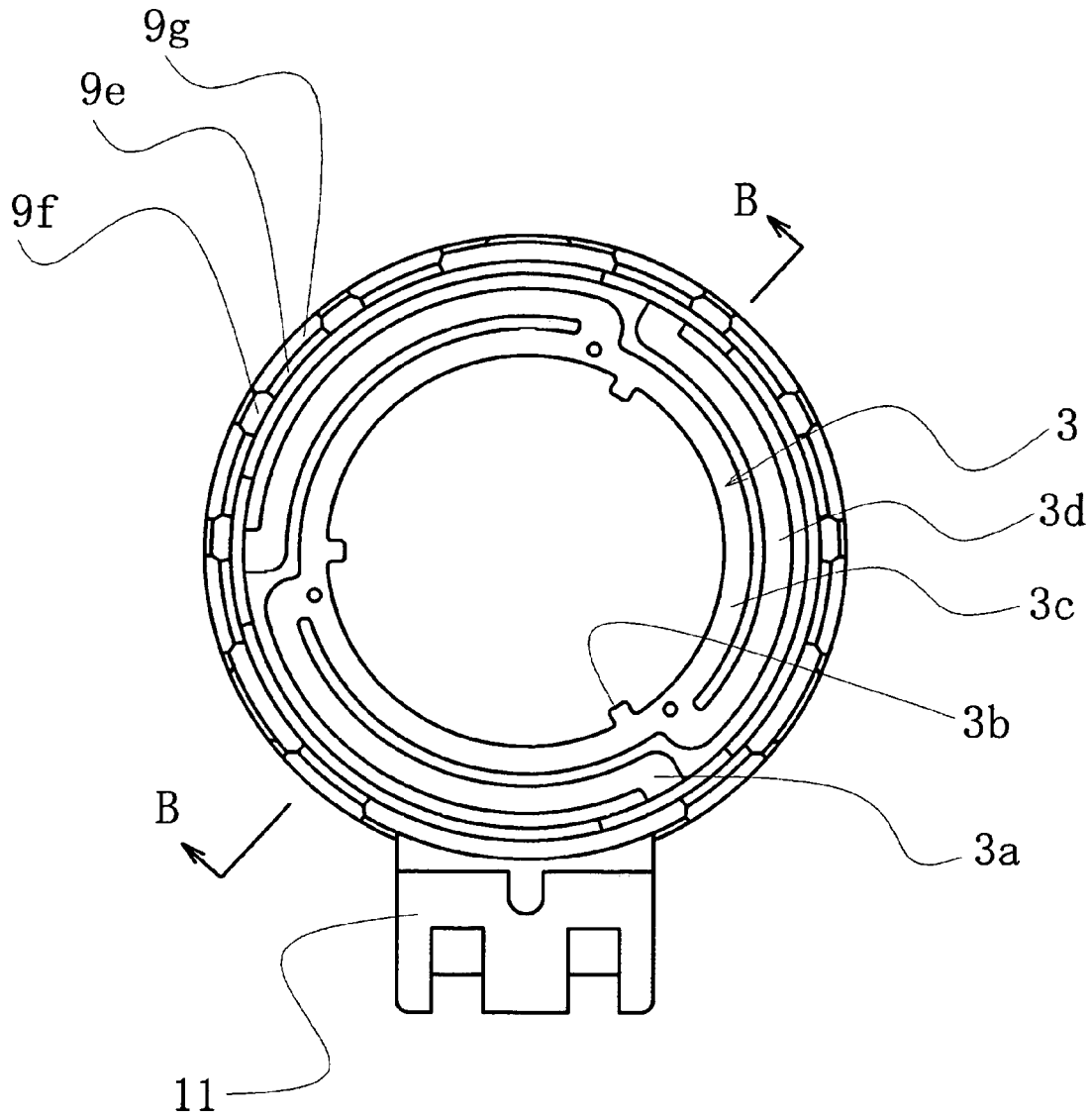
FIG. 4 is an explanatory diagram of a suspension and a housing of the multifunctional actuator of the present embodiment.

The suspension 3, as shown in FIG. 4, has tabs 3*a* that are fixed by molded pieces 9*b* of the housing 9, and it supports the magnetic circuit 2 in a position facing the diaphragm 4. As shown in FIG. 4, this suspension 3 is a ring-shaped leaf spring that gives flexible support to the magnetic circuit 2.

The suspension 3 has a ring 3*c* that fits into the outside of the stop frame 6*f* so that fittings 3*b* fit into cut-outs 6*g* of the yoke; the positions of the arms 3*d* face the positions of the suspension escapes 6*b*. Because of this, the yoke 6 can be mounted in the suspension 3 by fitting its end face 6*e* into the ring 3*c*.

The pole piece 8 has a back facing 8*a* to position the magnet 7, as shown in FIGS. 1 and 2. The diameter of this back facing 8*a* is approximately the same as the diameter of the magnet 7, so that the magnet 7 can be positioned. With back facings 8*a* and 6*d* on the pole piece 8 and the yoke 6 to position the magnet 7, it is possible to position the magnet 7 and to control slippage of the magnet 7 in the radial direction.

The diaphragm 4 is fixed to one end of the housing 9. The voice coil 5 is attached to this diaphragm 4. The voice coil 5 is formed in circular shape, and is inserted into a circular air gap G1 of the magnetic circuit 2.

The housing 9 is a cylindrical case that accommodates the magnetic circuit 2. The inner surface of the housing 9 has, as shown in FIG. 1, the circular step 9*a*. This circular step 9*a* makes contact with the step face 6*a* of the yoke 6 when the magnetic circuit 2 is vibrating, and controls the vibration of the magnetic circuit 2.

A cover 10 is formed as a cylinder with a floor; it covers the other end of the housing 9. A side wall 10*a* of this cover 10, as shown in FIG. 2, has holes 10*b* in it. The holes 10*b* are located in three places, and each fits with one of projections 9*c* on the periphery of the housing 9. In this way, the holes 10*b* of the cover 10 and the projections 9*c* of the housing 9 fit together so that the cover 10 is fixed to the other end of the housing 9.

Figure 5:
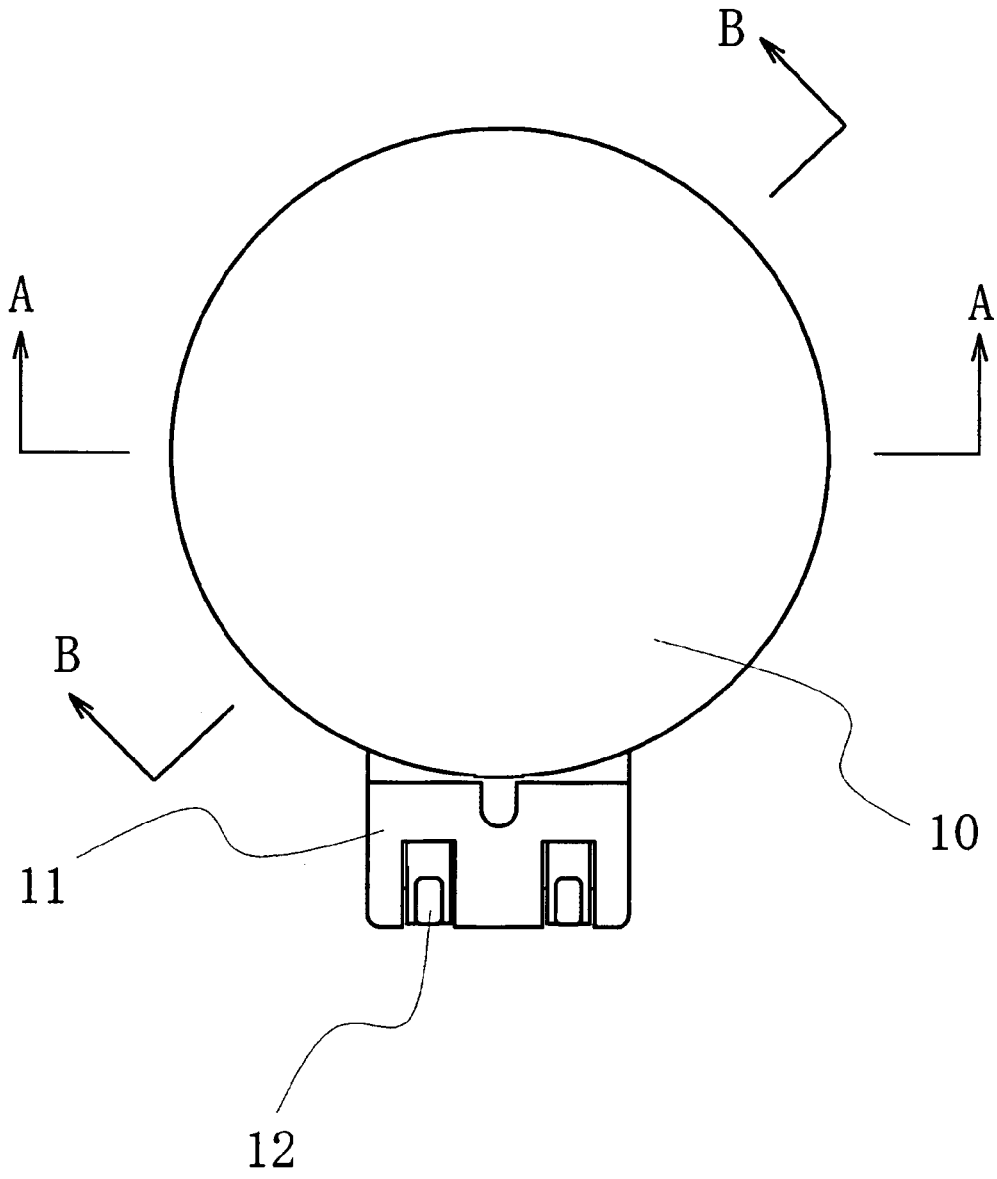
FIG. 5 is a top view of the multifunctional actuator of the present embodiment.

As shown in FIGS. 4 and 5, there is a terminal seat 11 on the outside of the housing 9; this terminal seat 11 holds terminal fittings 12. These terminal fittings 12 are electrically connected to the lead wires of the voice coil 5.

Figure 6:
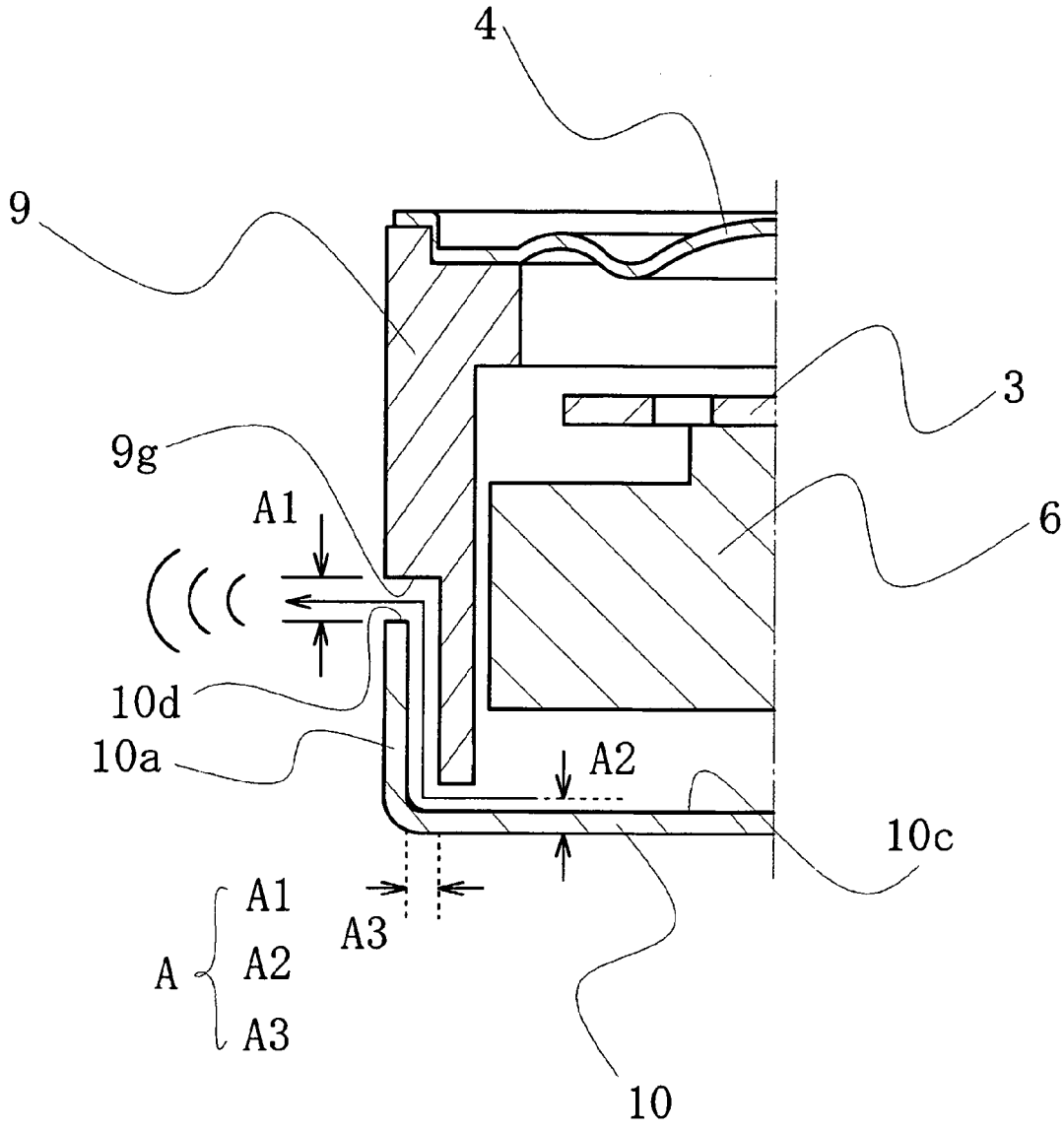
FIG. 6 is an enlarged sectional view of the multifunctional actuator of the present embodiment, taken along line B-B (see FIGS. 4 and 5).

A sound release gap, which is the primary feature of the present invention, will be described next. As shown in FIG. 6, a sound release gap A is established between the outer periphery of the housing 9 and the side wall 10*a* of the cover 10 for communication between the inside and outside of the housing 9. As shown in FIG. 2, the sound release gap A is formed by thin parts 9*d* provided on the outer periphery of the housing 9, cut-outs 9*e* provided on the open ends of the thin parts 9*d*, and the side wall 10*a* of the cover 10.

The thin parts 9*d* are located at multiple points along the outer periphery of the housing 9. The open ends of these thin parts 9*d* are cut away to allow air to move back and forth between the inside and the outside of the housing 9. Moreover, the projections 9*c* are formed as a single unit with the outer periphery of the housing 9 at three points.

When the housing 9 and the cover 10 are fitted together so that the projections 9*c* fit the holes 10*b* in the cover 10, a cover face 10*c* shown in FIG. 6 and an open end 9*f* of the housing 9 shown in FIG. 2 are in contact, and the cover face 10*c* covers the cut-outs 9*e*, so that a gap A2 (see FIG. 6) that connects the inside and the outside of the housing 9 is formed between the cover face 10*c* and the cut-outs 9*e*. Further, the thin parts 9*d* face the side wall 10*a* of the cover 10 across a gap A3, and a gap A1 is formed between a side wall edge 10*d* of the cover 10 shown in FIG. 6 and cut-outs 9*g* of the housing 9 shown in FIG. 2.

Figure 7:
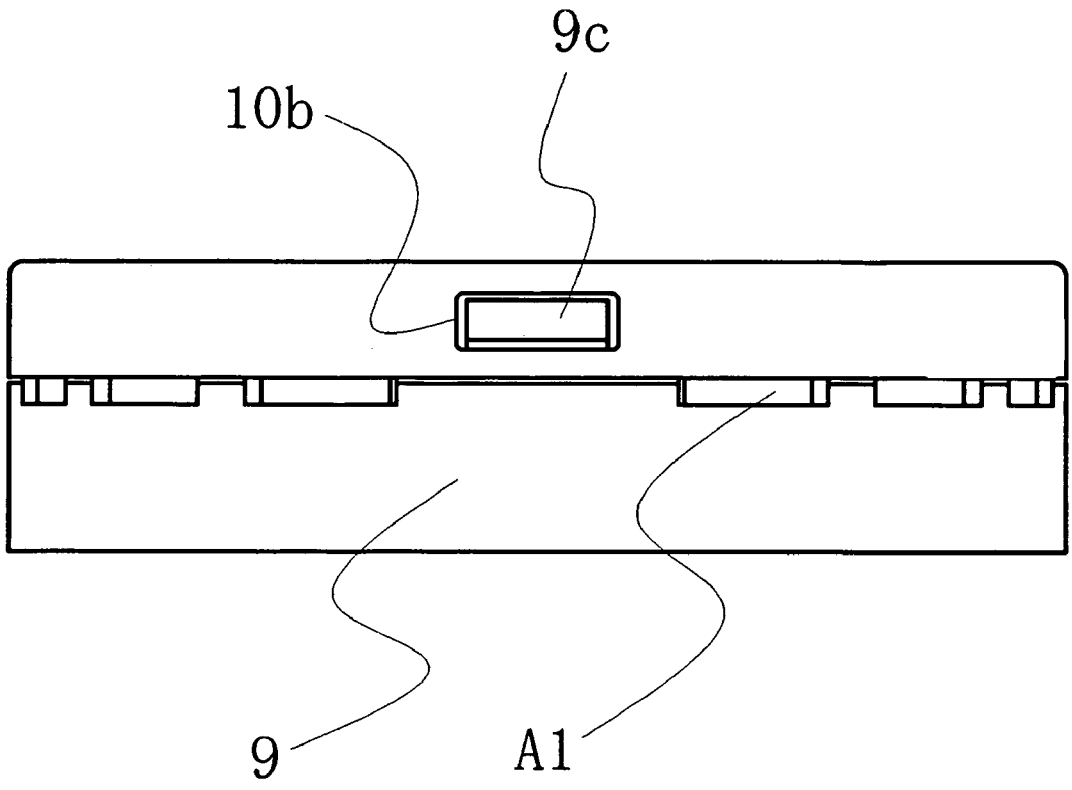
FIG. 7 is a side view of the multifunctional actuator of the present embodiment.

This gap A1, as shown in FIGS. 6 and 7, is an opening in the multifunctional actuator 1 in the radial direction, but the course from the gap A1 to the gap A3 is bent at right angles. The course from the gap A3 to the gap A2 is also bent at right angles. In this way, the sound release gap A of the multifunctional actuator comprises the gaps A1 through A3, and has a structure such that it is difficult for foreign matter to infiltrate the housing 9 directly.

Herein, the housing 9 of the multifunctional actuator 1 of the present embodiment has the thin parts 9*d* at 10 points, but this number can be varied as appropriate to the diameter and audio characteristics of the housing 9; the invention is not limited to 10 points. Further, the housing 9 has the projections 9*c* at three points, but the invention is not limited to designs with three projections.

Next, a clearance G2 of the multifunctional actuator 1 of the present embodiment will be described in detail referring to FIG. 1. The clearance G2 is formed by having the outer periphery of the yoke 6 approach as close as possible to the inside wall of the housing 9. Therefore, when the magnetic circuit 2 vibrates up and down, the air within the housing 9 applies air pressure generated by the vibration of the magnetic circuit 2 to the small clearance G2. Because it is difficult for the air to which this air pressure is applied to pass through the small clearance G2, the movement of air within the housing 9 is restricted. The air that is limited in its movement functions as a damper to counter the vibratory movement of the magnetic circuit 2.

By this means, the acceleration required for bodily sensation is available over a broad frequency range. The point of resonance is therefore unlikely to fall outside that frequency range, and so it is easier to set the point of resonance.

The multifunctional actuator 1 also has an audio generation function of generation sound with the diaphragm 4, and so if the outer framework that consists of the diaphragm 4, the housing 9 and the cover 10 were completely air-tight, the vibratory characteristics of the diaphragm 4 would deteriorate when generating low frequencies, and the audio characteristics would be impaired. On the other hand, because the air within the multifunctional actuator 1 is used as a damper, it is necessary to restrict the outflow of air. In order to harmonize these two opposing factors in a single multifunctional actuator, the sound release gap A is established in the side of the housing 9 as shown in FIG. 6. Air can enter and exit smoothly by this means, and good audio characteristics can be maintained.

The operation of the multifunctional actuator 1 of the embodiment will be described on the basis of the structure described above. When a signal is impressed on the voice coil 5, a driving force based on Fleming's left hand rule operates between the voice coil 5 and the magnetic circuit 2, and vibration begins. If the current frequency at that time is higher and in the audible frequency range, the vibration of the diaphragm 4 attached to the voice coil 5 is greater and an audio signal such as a ring tone, melody, or voice is generated.

On the other hand, the suspension 3 hardly vibrates at all because its characteristic vibration frequency is lower. When the current frequency is a relatively low frequency—from 120 to 160 Hz—the diaphragm 4 produces little movement and little sound, but there is greater vibration of the suspension 3 to which the magnetic circuit 2 is fixed. For that reason, the vibration generated is passed through the housing 9 to the mobile phone in which the multifunctional actuator 1 is mounted, and the user is informed of an incoming call.

In this way, the multifunctional actuator 1 performs two types of operation of generating sounds and vibrating.

The present embodiment has been described using the example of a multifunctional actuator of the internal magnet type, but the present invention is not limited to that type; it can be applied to multifunctional actuators of the external magnet type. Further, the constitution of the magnetic circuit is not limited to the constitution described for the present embodiment.

Further, the present embodiment was described using the example of the multifunctional actuator 1 of the air damper type, but the multifunctional actuator 1 of the present invention is not limited to the multifunctional actuator 1 of the air damper type, but could also be a multifunctional actuator with the wide clearance G2.

Moreover, the present embodiment has been described using the example of the multifunctional actuator 1 with the single type of suspension 3, but the multifunctional actuator 1 of the present invention is not limited to the multifunctional actuator 1 of the single type of suspension 3; the multifunctional actuator can be of the double suspension type. The multifunctional actuator can have two suspensions at the top and bottom of the magnetic circuit.

INDUSTRIAL APPLICABILITY

As described above, the present invention relates to the multifunctional actuator that is mounted in the mobile terminal such as the mobile phone and the miniature information communication terminal to inform the user, by means of the audible tone or vibration, of the incoming call, and particularly to the multifunctional actuator that has the sound release hole.

The present invention, because it has the sound release gap formed by the housing and the cover, is effective in preventing the infiltration of foreign matter into the housing without attaching an anti-dust mesh or non-woven fabric over the sound release holes. Further, the sound release gap is located on the side of the multifunctional actuator, and so it is possible to attach the multifunctional actuator securely to the base plate or other surface. For that reason, the present invention is effective in reducing the overall thickness of the mobile phone or other equipment in which the multifunctional actuator is mounted. Moreover, the thin part and the cut-out of the housing can be easily formed by injection molding, and so it is possible to hold down production costs.

The invention claimed is:

1. A multifunctional actuator including a magnetic circuit, a suspension that supports the magnetic circuit, a diaphragm positioned facing the magnetic circuit, and a voice coil that is mounted on the diaphragm and inserted in a circular air gap of the magnetic circuit, comprising:

a housing to accommodate said magnetic circuit;

a cover to cover an open end of said housing; and a sound release gap formed between an outer periphery of said housing and a side wall of said cover for communication between the inside and outside of said housing, wherein the sound release gap formed is a communication path having a bend portion so as to prevent infiltration of foreign matter.

2. The multifunctional actuator as described in claim 1, wherein said sound release gap is formed by a thin part provided at the outer periphery of said housing, a cut-out provided on an open end of said thin part, and the side wall of said cover.

3. The multifunctional actuator as described in claim 1, wherein there are provided a hole in the side wall of said cover and a projection on the outer periphery of said housing that fits into said hole.

4. The multifunctional actuator as described in claim 2, wherein there are provided a hole in the side wall of said cover and a projection on the outer periphery of said housing that fits into said hole.

5. A mobile terminal equipped with the multifunctional actuator as described in claim 1.

6. A mobile terminal equipped with the multifunctional actuator as described in claim 2.

7. A mobile terminal equipped with the multifunctional actuator as described in claim 3.

8. A mobile terminal equipped with the multifunctional actuator as described in claim 4.

* * * * *